United States Patent [19]

Chesluk et al.

[11] 4,125,479

[45] Nov. 14, 1978

[54] OXIDATION INHIBITED LUBRICATING OIL

[75] Inventors: Ralph P. Chesluk, Nederland; John D. Askew, Jr., Houston; Clifton C. Henderson, Port Arthur, all of Tex.

[73] Assignee: Texaco Inc., New York, N.Y.

[21] Appl. No.: 750,069

[22] Filed: Dec. 13, 1976

Related U.S. Application Data

[63] Continuation-in-part of Ser. No. 642,972, Dec. 22, 1975, abandoned.

[51] Int. Cl.[2] ..... C10M 1/54

[52] U.S. Cl. ..... 252/33.6; 252/47.5; 252/402

[58] Field of Search ..... 252/33.6, 47.5, 47, 252/402

[56] References Cited

U.S. PATENT DOCUMENTS

| | | | |
|---|---|---|---|
| 2,160,880 | 6/1939 | Loane et al. | 252/47.5 X |
| 2,201,258 | 5/1940 | Busse | 252/47.5 X |
| 2,251,686 | 8/1941 | Musselman et al. | 252/47 |
| 2,371,319 | 3/1945 | Ross et al. | 252/47 |
| 2,681,316 | 6/1954 | Harle | 252/47.5 |
| 2,691,632 | 10/1954 | Harle | 252/47.5 X |
| 3,249,542 | 5/1966 | Barry | 252/47.5 |
| 3,251,811 | 5/1966 | Warner et al. | 252/402 X |
| 3,931,022 | 1/1976 | Chesluk et al. | 252/47.5 |

OTHER PUBLICATIONS

Denton, W. M. et al., "Screening of Compounds for Anti-oxidant Activity in Motor Oil", Ins. Pet. Rev., 1966, vol. 20.

*Primary Examiner*—Delbert E. Gantz
*Assistant Examiner*—Andrew Metz
*Attorney, Agent, or Firm*—Carl G. Ries; Thomas H. Whaley; Kenneth R. Priem

[57] ABSTRACT

Lubricating oils with superior oxidation inhibition result from the combination of additives in a lubricating oil base; the ashless additive combination comprising methylene bis(dibutyl dithiocarbamate) and 4-methyl-2,6-ditertiary butyl phenol. The above combination of additives displays synergistic activity as an oxidation inhibitor.

4 Claims, No Drawings

OXIDATION INHIBITED LUBRICATING OIL

This application is a continuation-in-part of copending application Ser. No. 642,972, filed Dec. 22, 1975, now abandoned.

BACKGROUND OF THE INVENTION

1. Field of the Invention

This invention relates to the field of oxidation inhibition in lubricating oils.

2. Description of the Prior Art

Lubricating oils such as turbine oils and transformer oils as well as others require an additive package containing, among other things, an oxidation inhibitor. Without such an inhibitor the lubricating oils would quickly succumb to attack by heat and oxidizing agents and the lubricating capabilities would be lost. Although many compounds are capable of providing some oxidation inhibition, it has now been discovered that a peculiar combination of additives provide synergistic activity. That is, the invention herein described discloses a combination of additives whereby the oxidation inhibition relaized is greater than that attained by either additive used alone.

Quimby's U.S. Pat. No. 2,285,129 discloses 2-benzothiazyl-N,N-diethyldithiocarbamate in combination with 4-methyl-2,6-ditertiary butyl phenol. However, this combination displays no synergistic activity.

Schmitz's U.S. Pat. No. 2,713,558 discloses a combination of additives for extreme pressure improvement comprising selenium dibenzylthiocarbamate and 2,6-ditertbutyl-4-methylphenol. An ash forming additive combination of this type is not useful in my invention.

SUMMARY OF THE INVENTION

The invention is a lubricating oil comprising a base oil and an ashless combination of additives comprising methylene bis(dibutyl dithiocarbamate) and 4-methyl-2,6-ditertiary butyl phenol. The invention also comprises a lubricating oil and an additive combination comprising methylene bis(dibutyl dithiocarbamate) and tetrahydrobenzotriazole.

DESCRIPTION OF THE PREFERRED EMBODIMENTS

The additive combinations disclosed as the invention herein may be used in any lubricating oil wherein oxidation inhibition is required. This may include transformer oils, turbine oils, engine oils and other oils which are subjected to conditions where oxidation is a problem.

One class of oils wherein the additive combinations of this invention find use is in turbine oils. The base oil for turbine oils is generally a mineral oil having viscosity characteristics suitable for turbine lubricants. Illustrative thereof are low viscosity oils suitable for preparation of light turbine oils. These may have viscosities which range from about 140 to about 170 SUS at 100° F. and flash points of between 300° and 350° F. minimum. These light turbine oils usually have a specific gravity between about 0.850 and 0.900. Where required, higher viscosity oils are suitable as turbine oils. These high viscosity oils generally have a specific gravity of between 0.850 and 0.930 and a minimum flash point of between about 430° and 470° F. The viscosity of these oils may range from 600 to 800 SUS at 100° F. Oils suitable for turbine oil application may be refined by various means. One sequence includes solvent refining, followed by dewaxing and hydrogenation, and finally clay percolation. These descriptions of suitable turbine oils and their method of manufacture is not considered to be restrictive and are given only as examples.

The additive combination of this invention will also find use in transformer oils. Transformer oils are generally made from a naphthene base crude. This naphthenic oil is generally treated with either sulfuric acid and/or hydrogen. These naphthenic oils may range in viscosity from about 50 SUS at 100° F. to about 200 SUS at 100° F. Although it is not absolutely necessary to produce oils acceptable for our invention, it is preferred that before acid treating or hydrogenation of the base naphthenic oils that a caustic washing take place. Caustic washing is an accepted practice in industry and the process is well known. The transformer oil base may then be percolated through clay at conditions known to those skilled in the art.

The indentity of the base oil is not restricted to the ones enumerated since the heart of the invention lies in the combination of additive detailed hereafter.

In one embodiment of our invention a synergistic ashless combination of two additives provides oxidation inhibition superior to oxidation inhibition supplied by either additive used alone (see Table I). These additives are (1) methylene bis(dibutyl dithiocarbamate) and (2) 4-methyl-2,6-ditertiary butyl phenol. The first additive above, the "carbamate," may be used in concentrations of from 0.1 to 4.0 weight percent of the total lubricant mixture but it is preferred that it be used in concentrations ranging from 0.5 to 2.0 weight percent of the total mixture. The "butyl phenol" additive may be used in concentrations ranging from 0.01 to 2.0 weight percent of the total mixture. However, it is preferred that it be used in concentrations ranging from 0.05 to 0.30 weight percent of the total mixture.

Other additives which impart beneficial properties to the lubricating oils may be used in addition to this synergistic combination of additives and this invention includes the use of the combination above as well as any other additive members which may be needed for a specific application such as rust and foam inhibitors.

My invention also includes the combination of additives comprising (1) methylene bis(dibutyl dithiocarbamate) and (2) tetrahydrobenzotriazole. The "carbamate" additive may be used in a concentration ranging from 0.1 to 5.0 weight percent of the total mixture; however, it is preferred that it be used in a concentration ranging from 0.5 to 2.0 weight percent of the total mixture. The tetrahydrobenzotriazole additive may be used from 0.001 to 0.05 weight percent of the total mixture; however, it is preferred that it be used in concentrations ranging from 0.01 to 0.03 weight percent of the total mixture.

The following laboratory data proves that the combination of additives shown above displays outstanding performance. The data particularly shows that the combination of additives comprising methylene bis(dibutyl dithiocarbamate) and 4-methyl-2,6-ditertiary butyl phenol displays a synergistic activity in inhibiting oxidation.

EXPERIMENTAL

The following tests were performed to demonstrate the advantages of our invention:

ASTM D 2272 Rotary Bomb Oxidation Test (RBOT)

This test provides a rapid means for estimating the oxidation stability of new turbine oils having the same composition (base stock and additives). In addition, the test is used to assess the remaining oxidation test life of such oils in service.

The test oil, water and copper catalyst coil, contained in a covered glass container, are placed in a bomb equipped with a pressure gauge. The bomb is charged with oxygen to a pressure of 90 PSI, placed in an oil bath which is held at a constant temperature of 150° C., and rotated axially at 100 rpm at an angle of 30° from the horizontal. The time it takes the test oil to react with a given volume of oxygen is measured. Test completion time is indicated by a specific drop in pressure (more than 25 PSI drop below the maximum pressure).

Oven Test

The test oil sample is poured in 200 ml aliquots into seven beakers. The beakers are then placed in an oven which is held at a constant temperature of 180° F. Every 24 hours, a sample is removed to determine the percent of anti-oxidant remaining. In addition, each sample is tested in the Rotary Bomb Oxidation Test to assess the remaining oxidation life of each sample. The Oven Test is terminated after 168 hours.

Tables I and II demonstrate the synergistic effect on oxidation inhibition resulting from an additive combination comprising 4-methyl-2,6-ditertiarybutylphenol and methylene bis(dibutyl dithiocarbamate). As Table II shows, no synergism is noted when 2-benzothiazyl-N,N-diethyl dithiocarbamate is substituted for methylene bis(dibutyl dithiocarbamate).

TABLE I

RESULTS OF RBOT STUDY

| Composition (Wt. %) | A | B | C | D | E | F | G | H |
|---|---|---|---|---|---|---|---|---|
| Paraffinic Base Oil* | 99.85 | 98.85 | 99.00 | 99.83 | 98.83 | 98.98 | 98.85 | 98.85 |
| 4-methyl-2,6-ditertiary butyl phenol (MDBP) | 0.15 | 0.15 | — | 0.15 | 0.15 | — | 1.15 | — |
| Methylene bis (dibutyl dithiocarbamate) | — | 1.0 | 1.0 | — | 1.0 | 1.0 | — | 1.15 |
| Tetrahydrobenzotriazole | — | — | — | 0.02 | 0.02 | 0.02 | — | — |
| Test Results RBOT, Min. | 141 | 1125 | 240 | 284 | 703 | 205 | 205 | 580 |

TABLE II

| | A | B | C | D | E | F |
|---|---|---|---|---|---|---|
| Composition, Wt. % | | | | | | |
| Paraffinic Base Oil | 99.950 | 99.950 | 99.9565 | 99.9565 | 99.93 | 99.93 |
| MBDP (4-methyl-2,6 ditert Butyl phenol) | 0.0065 | 0.0065 | — | — | 0.0065 | 0.0065 |
| Ethylac | 0.0435 | — | 0.0435 | — | 0.0435 | — |
| Methylene bis(dibutyl dithiocarbamate) | — | 0.0435 | — | 0.0435 | — | 0.0435 |
| Tetrahydrobenzotriazole | — | — | — | — | 0.020 | 0.02 |
| Test Results RBOT Min. | 37 | 63*** | 32 | 33 | 47 | 49 |
| | G | H | I | J | K | |
| Composition, Wt. % | | | | | | |
| Paraffinic Base Oil* | 99.93 | 99.93 | 99.95 | 99.95 | 99.99 | |
| MBDP (4-methyl-2,6 ditert butyl phenol) | — | — | — | — | 0.065 | |
| Ethylac** | 0.05 | — | 0.05 | — | — | |
| Methylene bis(dibutyl dithiocarbamate) | — | 0.05 | — | 0.05 | — | |
| Tetrahydrobenzothiazole | 0.02 | 0.02 | — | — | — | |
| Test Results RBOT, Min. | 38 | 36 | 33 | 33 | 55 | |

*Contains rust and foam inhibitors.
**2-benzothiazyl-N,N-diethyldithiocarbamate (not soluble in base oil in larger concentrations)
***Average of two runs (55 and 70)

This test provides a measure of the volatility of various anti-oxidants evaluated in turbine oil formulations.

TABLE III

RESULTS OF OVEN TEST (180° F.)

| PARL-L-74 | 8546 | | | 1322 | | 6270 | |
|---|---|---|---|---|---|---|---|
| Composition (Wt. %) | | | | | | | |
| 142 SUS Viscosity Paraffinic Oil | 80.454 | | | 98.967 | | 78.865 | |
| 675 SUS Viscosity Paraffinic Oil | 18.263 | | | — | 20.08 | | |
| Methylene bis(dibutyl dithiocarbamate) | 1.0 | | | — | | 1.0 | |
| 4-methyl-2,6-ditertiary butyl phenol (MDBP) | 0.15 | | | 1.0 | | — | |
| Tetrahydrobenzotriazole | — | | | — | | 0.02 | |
| Viscosity Improver* | 0.10 | | | — | | — | |
| Anti-Rust Concentrate** | 0.033 | | | 0.033 | | 0.035 | |
| Poly (2-ethylacrylate), ppm added | 50 | | | 50 | | 50 | |
| Test Results | | | | | | | |
| Time in Oven (Hr.) | % MDBP in sample | RBOT Min. | % initial MDBP | % MDBP in sample | % initial MDRP | % LZ-5148 in sample | % initial LZ-5148 |
| 0 | 0.16 | 1225 | 100 | 1.0 | 100.0 | 1.0 | 100 |
| 24 | 0.17 | 760 | 106 | 0.84 | 84.0 | 0.9 | 90 |
| 48 | 0.15 | 745 | 93.75 | 0.69 | 69.0 | 1.0 | 100 |
| 96 | 0.065 | 750 | 40.62 | 0.51 | 51.0 | 1.0 | |
| 120 | 0.072 | — | 45.0 | — | — | 1.0 | 100 |

TABLE III-continued

| | | RESULTS OF OVEN TEST (180° F.) | | | | |
|---|---|---|---|---|---|---|
| 168 | 0.097 | 440 | 48.12 | 0.39 | 39 | — |

*Copolymer of lauryl and stearyl methacrylates
**Mixture of tetrapropenyl maleic acid, phenol and lauryl acid phosphate.

We claim:

1. A lubricating oil comprising:
(a) a paraffinic base oil,
(b) methylene bis(dibutyl dithiocarbamate) comprising from about 0.1 to 4.0 weight percent of the total mixture and
(c) 4-methyl-2,6-ditertiary butyl phenol comprising from about 0.01 to 2.0 weight percent of the total mixture.

2. An oil as in claim 1 wherein the methylene bis(-dibutyl dithiocarbamate) is present in amounts ranging from about 0.5 to 2.0 weight percent of the total mixture and the 4-methyl-2,6-ditertiary butyl phenol is present in amounts 0.05 to 0.30 weight percent of the total mixture.

3. A lubricating oil as in claim 1 where the oil is a mineral oil.

4. A lubricating oil comprising
(a) a paraffinic base oil,
(b) from 0.1 to 4.0 weight percent based on the total mixture of methylene bis(dibutyl dithiocarbamate) and
(c) from 0.01 to 2.0 weight percent based on the total mixture of 4-methyl-2,6-ditertiary butyl phenol.

* * * * *